US005813659A

United States Patent [19]

Heidle

[11] Patent Number: 5,813,659

[45] Date of Patent: Sep. 29, 1998

[54] MANUAL HOIST FOR USE BY AUTO MECHANICS

[76] Inventor: Timothy Heidle, 956 Parker Rd., Hamburg, N.Y. 14075

[21] Appl. No.: 804,011

[22] Filed: Feb. 21, 1997

[51] Int. Cl.[6] ..... B66D 1/00

[52] U.S. Cl. ..... 254/334; 254/199

[58] Field of Search ..... 248/317, 339, 248/327; 269/46; 29/273; 254/324, 334, 199

[56] References Cited

U.S. PATENT DOCUMENTS

| | | | |
|---|---|---|---|
| 431,826 | 7/1890 | Van Wagenen . | |
| 566,851 | 9/1896 | Ferguson . | |
| 586,681 | 7/1897 | Douglas . | |
| 653,386 | 7/1900 | Hunter . | |
| 1,289,233 | 12/1918 | Neal . | |
| 1,416,958 | 5/1922 | Kelley et al. | 29/273 |
| 2,564,510 | 8/1951 | Shoemaker | 248/317 |
| 2,565,978 | 8/1951 | Meriwether | 248/339 |
| 3,321,169 | 5/1967 | Fowler | 29/273 |
| 3,491,427 | 1/1970 | Zimmerman et al. . | |
| 5,244,331 | 9/1993 | Ruhl | 29/273 |
| 5,257,446 | 11/1993 | Steves, Jr. et al. | 29/273 |
| 5,263,687 | 11/1993 | Garbiso | 248/327 |
| 5,379,519 | 1/1995 | Paddock et al. | 269/46 |

*Primary Examiner*—Katherine Matecki
*Attorney, Agent, or Firm*—Bilicki & Simpson, P.C.

[57] ABSTRACT

A manual hoist for use by auto mechanics to remove and install a wheel on a vehicle, comprising a vertical frame, a cantilever arm pivotally secured to the frame, a strap having a first end and a second end, the first end operatively arranged to slidingly engage the cantilever arm, and, a fastener secured to the second end of the strap and operatively arranged to fasten to the wheel.

8 Claims, 4 Drawing Sheets

MANUAL HOIST FOR USE BY AUTO MECHANICS

FIELD OF THE INVENTION

This invention relates generally to manual hoists for use by auto mechanics.

BACKGROUND OF THE INVENTION

Others have attempted to solve the problem of assisting a person to install or remove a wheel from a vehicle. In U.S. Pat. No. 3,491,427, Zimmerman et al. disclose an apparatus for handling and assembling wheels upon an assembly line. The apparatus comprises a non-pivotable horizontal rail connected to a powered slidable hoist. The slidable hoist comprises an adjustable hoist line attached to a hydraulic device. The device fastens to a free-standing wheel at multiple locations of the wheel rim. Once fastened to the wheel, the device is able to rotate the wheel into proper position and fasten all five lug nuts of the wheel upon the vehicle axis in a minimum time frame. This apparatus was designed to solve the problem of placing wheels on an automobile on a moving assembly line.

Another method is disclosed by Fowler in U.S. Pat. No. 3,321,169. Fowler discloses a wheel handling device. The device comprises a vertical support bracket connected to a rigid horizontal rail. A slidable carriage is attached to the rail. The carriage comprises a bail that is pivotally suspended from the carriage. Attached to the bail is a securing means like a chain. The securing means is connected to a double wheel. The wheel is supported by the securing means for movement to and from a "jacked" vehicle. This device was designed to assist an ordinary person change a double wheel on a jacked vehicle.

Although these two patented inventions ostensibly solve certain problems, i.e., installing wheels on a vehicle on a moving assembly line, and removing and installing a double wheel on a jacked vehicle, they are not designed or appropriate for use by mechanics in automobile service shops. Vehicles serviced in such shops are not moving on assembly lines and are not jacked from the floor. They are almost always worked upon when elevated by a lift.

What is needed, then, is an apparatus for removing and installing vehicle wheels for use by mechanics in automobile service shops.

SUMMARY OF THE INVENTION

The invention broadly comprises a manual hoist for use by auto mechanics to remove and install a wheel on a vehicle, comprising a vertical frame, a cantilever arm pivotally secured to the frame, a strap having a first end and a second end, the first end operatively arranged to slidingly engage the cantilever arm, and, a fastener secured to the second end of the strap and operatively arranged to fasten to the wheel. Once the wheel is removed, it is suspended from the hoist. Thus, the mechanic avoids having to drop the wheel to the floor or lift the wheel from the floor.

It is therefore a primary object of the invention to provide an improved hoist to assist an auto mechanic remove and replace a wheel upon a vehicle without having to lift the wheel to the floor or to the elevated vehicle.

This and other objects and advantages of the present invention will be readily appreciable from the following description of preferred embodiments of the invention and from the accompanying drawings and claims.

BRIEF DESCRIPTION OF THE INVENTION

DETAILED DESCRIPTION OF THE PREFERRED EMBODIMENTS

Figure 1:
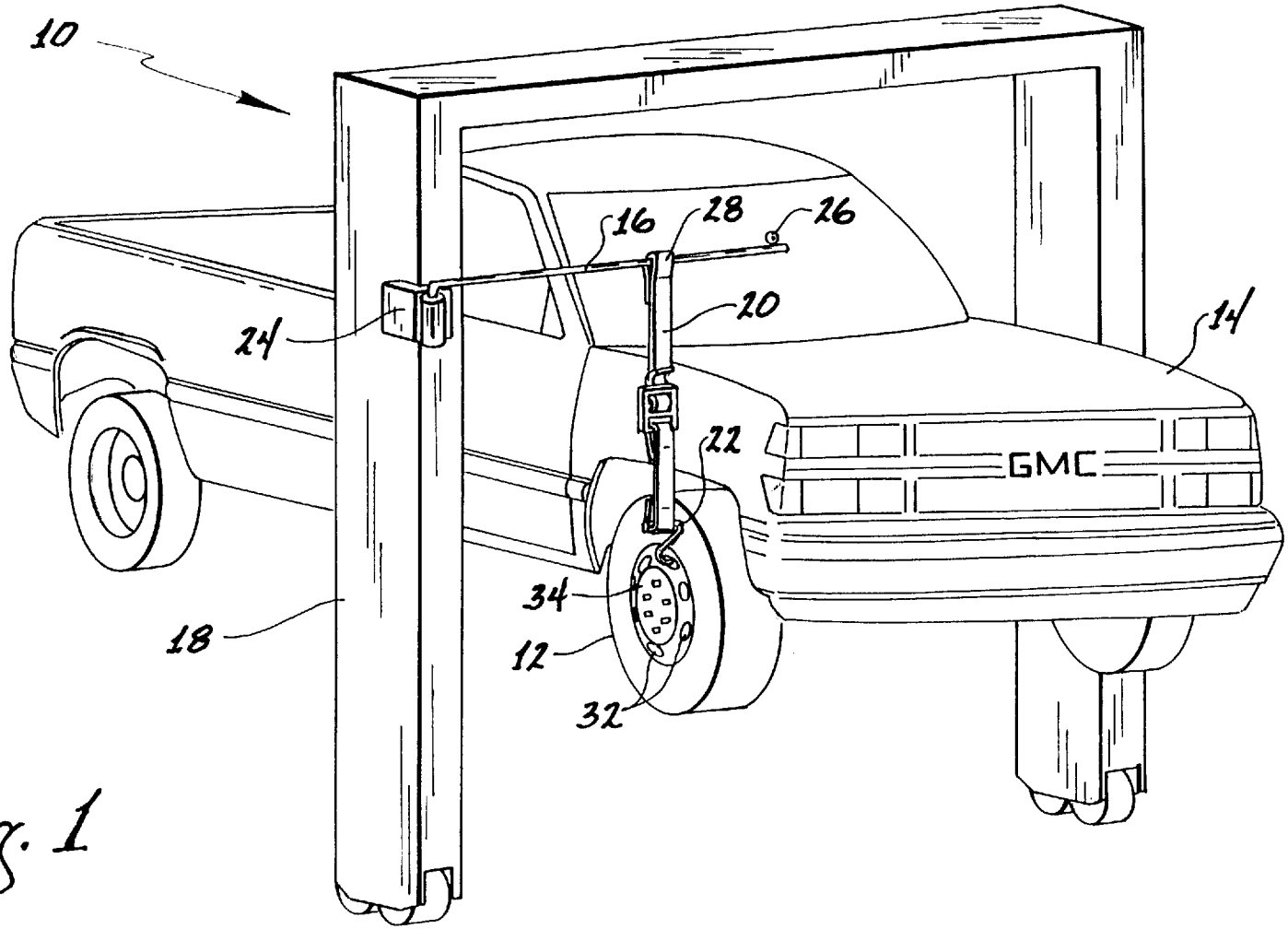
FIG. 1 is a perspective view of the invention about to be used to assist in removal of a wheel from an elevated vehicle.
Figure 2:
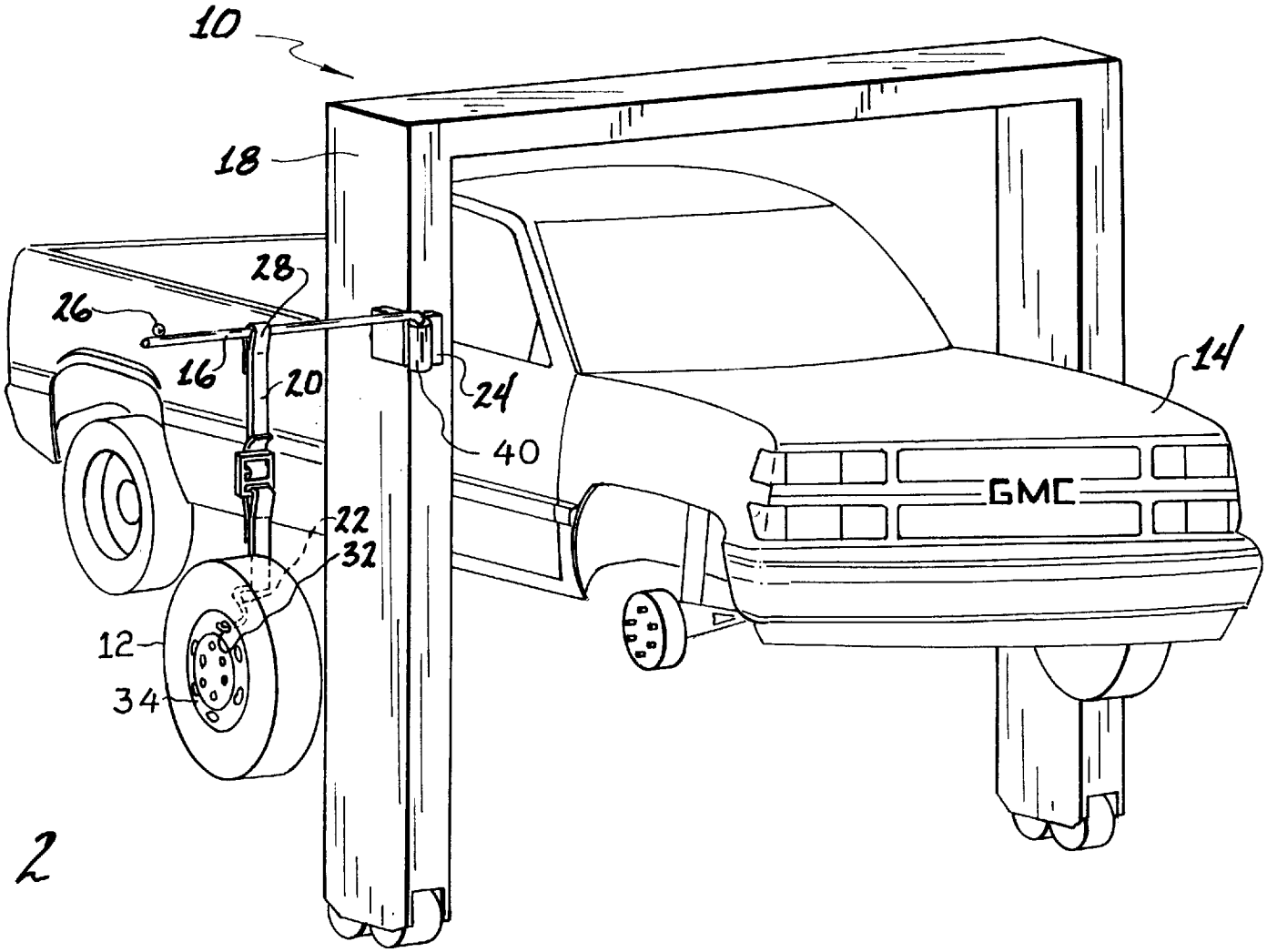
FIG. 2 is a view similar to that of FIG. 1, except showing the wheel removed and suspended from the hoist of the invention.

Adverting to FIG. 1, the subject invention is a hoist 10 that enables auto mechanics to easily remove and replace a wheel 12 on an elevated vehicle 14. (For simplicity, the hydraulic lift used to elevate the vehicle is not shown in the drawings.) The hoist 10 as shown in FIG. 1 comprises a pivotable cantilever arm 16 secured to a vertical frame 18. Although the vertical frame shown in FIG. 1 is an frame on wheels, it should be appreciated that other frame structures would suffice. For example, the frame could be permanently affixed to the floor; it could be a pole mounted on the floor; it need not be truly "vertical"; and it could even be a frame supported by the ceiling instead of the floor. Attached to the cantilever arm 16 is an adjustable strap 20 which slidingly engages the arm 16. At the distal end of the strap 20 is a fastener 22 that engages vehicular wheel 12. Once the wheel is removed as shown in FIG. 2, it is suspended from the hoist. The mechanic then avoids having to drop or lift the wheel.

The foundation of hoist 10 is the vertical frame 18. Frame 18 is a sturdy structure able to support the weight of a suspended wheel 12. Secured to frame 18 at a predetermined height is a cantilever mounting bracket 24. The cantilever mounting bracket 24 is made of a durable and strong material, like 12-gauge carbon steel. In this embodiment, cantilever mounting bracket 24 is bolted to frame 18 (although it could be welded or secured by other means.) Cantilever mounting bracket 24 comprises tubular member 40. Cantilever arm 16 is pivotally secured within the tubular member and is operatively arranged to pivot toward and away from the vehicle as shown in FIG. 1.

The cantilever arm 16 is a projecting member supported only by tubular member 40. The cantilever arm is also made of a durable and strong material, like a steel pipe, for example. The arm 16 has a length that allows an auto mechanic to easily remove and replace a vehicular wheel 12. Preferably, arm 16 has a length that protrudes beyond the distance between frame 18 and wheel 12. As shown in the drawings, cantilever arm 16 comprises a first section which is mounted within tubular member 40 and a second section disposed at a right angle thereto which is cantilevered outwardly from the first section. At the distal end of the cantilever arm is a stop 26 operatively arranged to prevent strap 20 from falling off the distal end of the cantilever arm.

Strap 20 can be made of any strong, flexible but preferably non-elastic material (canvas, plastic, etc.). Strap 20 comprises a first loop 28 at a first end and a second loop 30 at a second end. Loop 28 is sufficiently large enough to fit over the stopper 26. Loop 28 slidingly engages the cantilever arm, i.e., it permits the strap to move to and fro on the arm.

Figure 3:
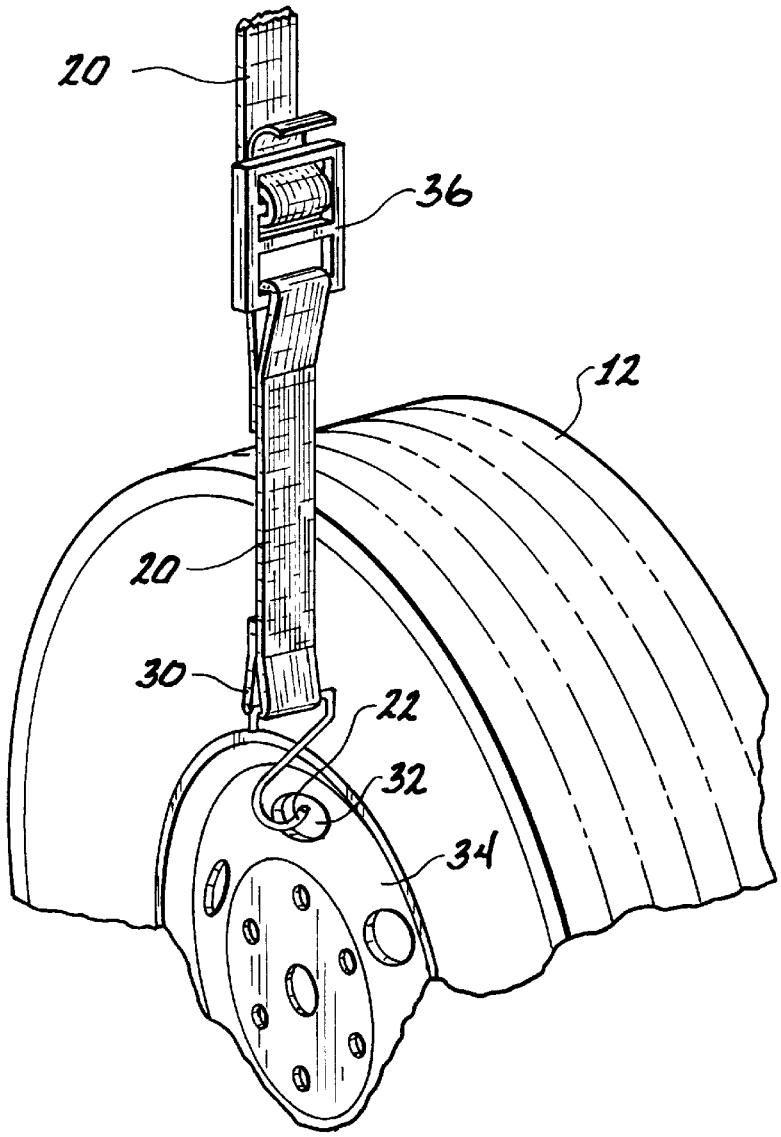
FIG. 3 is an enlarged view of the strap and fastener of the invention, shown as the fastener is being secured to a wheel.

Adverting to FIG. 3, fastener 22 is secured to loop 30 at the second end of strap 20. In a preferred embodiment, the fastener is a hook (e.g., S-hook), but may be any fastener capable of securing to a wheel. As shown in the drawing, one end of the S-hook is secured by loop 30 while the other end engages aperture 32 of rim 34 of wheel 12. Fastener 22 is secured to wheel 12 by removing any slack in strap 20. The slack is removed by adjusting the length of strap 20 through an adjustment clamp 36.

In another embodiment of the subject invention (not shown in the drawings), the upright frame 18 is a stationary pole. The pole is positioned near a permanent hydraulic lift or any other conventional lifting means so that a vehicle may be lifted and the subject invention practiced.

Figure 4:
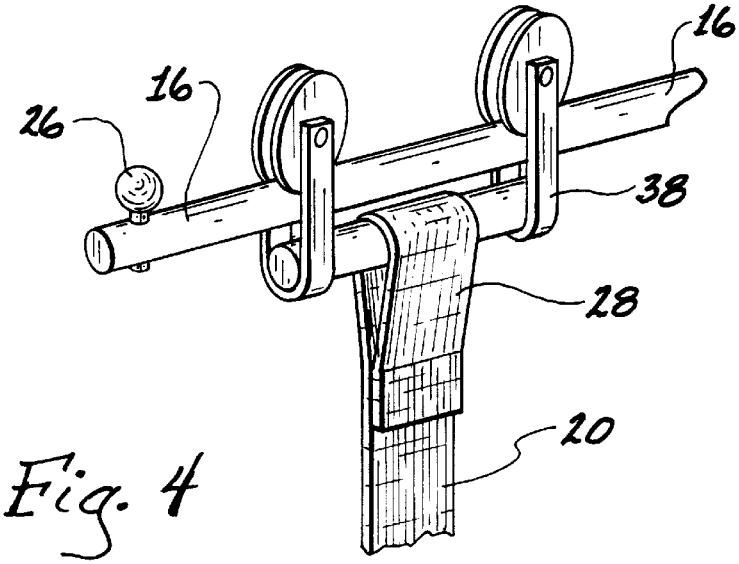
FIG. 4 is a view of an alternative means of securing the strap of the invention to the cantilever arm.
Figure 5:
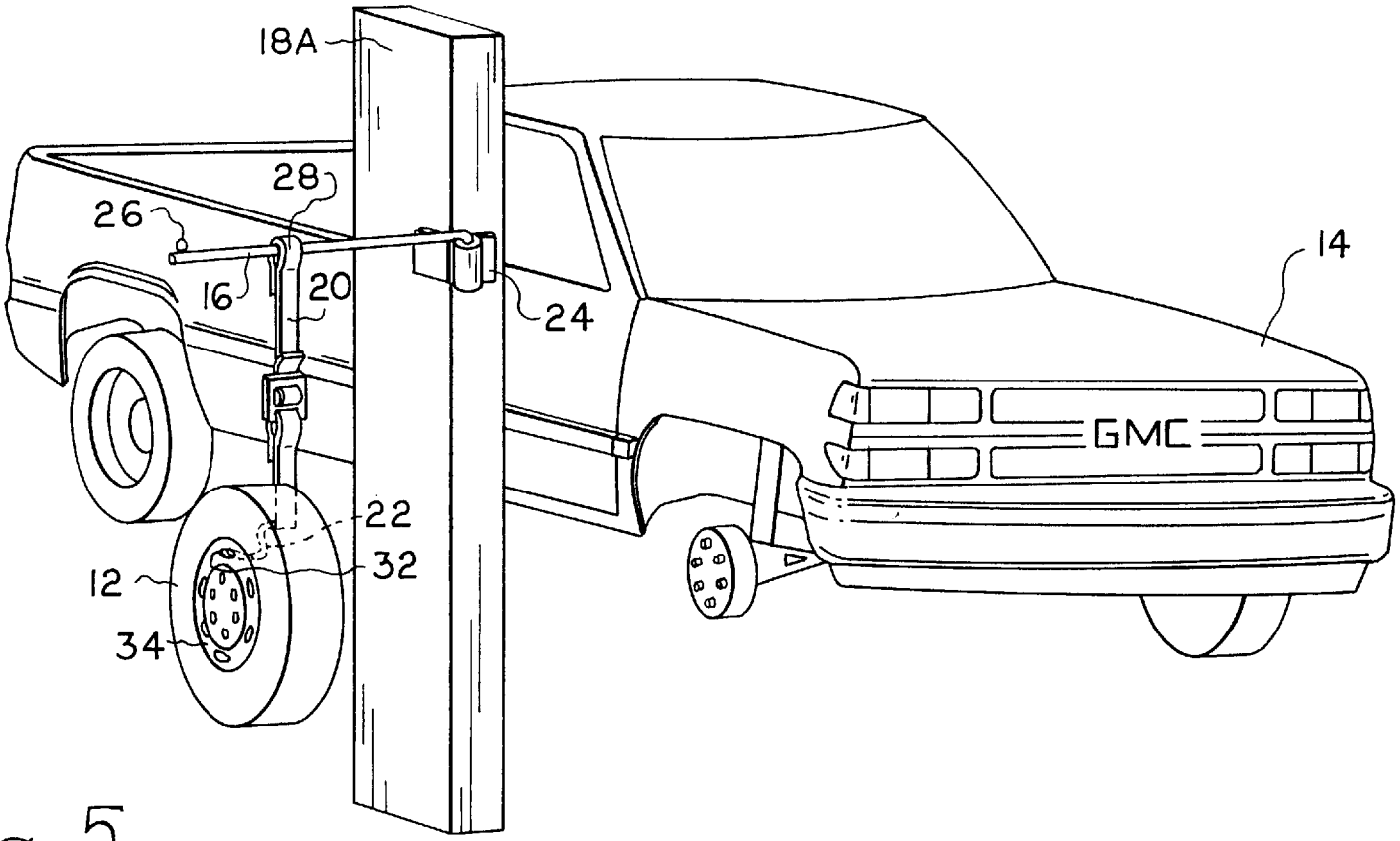
FIG. 5 is a perspective view of an alternative embodiment of the invention.

In yet another embodiment of the present invention as shown in FIG. 4, strap 20 is attached to a carriage 38 that slidingly moves along arm 16.

In one embodiment of the subject invention, hoist 10 is used in the following manner. A vehicle 14 is positioned under a portable lift proximate the hoist 10. Vehicle 14 is then lifted to a desired height. The cantilever arm 16 and strap 20 are pivoted into position above wheel 12. Fastener 22 is attached to wheel 12 and strap 20 and fastener 22 are adjusted to be taut. The lug nuts of wheel 12 are then individually removed. Once the lug nuts are removed, wheel 12 is pivoted away from vehicle 14 and suspended by hoist 10. Vehicle 14 is repaired or inspected as appropriate. The process is then reversed to install the wheel.

Although my invention is described by reference to specific preferred embodiments, it is clear that variations can be made without departing from the spirit of the invention as claimed.

What I claim is:

1. A manual hoist for use by auto mechanics to remove and install a wheel on a vehicle, comprising:

a vertical frame;

a cantilever arm pivotally secured to said frame and supported at one end only by said frame a strap having a first end and a second end, said first end slidingly engaging said cantilever arm; and, a fastener secured to said second end of said strap for use in attaching said strap to said wheel.

2. A hoist as recited in claim 1 further comprising a stopper at a distal end of said cantilever arm to prevent said strap from falling off said cantilever arm.

3. A hoist as recited in claim 1 wherein said strap has a first loop at said first end of said strap to slidingly engage said cantilever arm.

4. A hoist as recited in claim 1 wherein said strap has a second loop at said second end and said fastener is secured within said second loop.

5. A hoist as recited in claim 1 further comprising a slidable carriage which slidingly engages said cantilever arm and supports said strap.

6. A hoist as recited in claim 1 wherein said fastener is an S-hook.

7. A hoist as recited in claim 1 wherein said vertical frame comprises two vertical members and a transverse member secured therebetween to each of said vertical members.

8. A hoist as recited in claim 1 wherein said vertical frame is a pole.

* * * * *